US005470082A

United States Patent [19]

Clayton

[11] Patent Number: 5,470,082

[45] Date of Patent: Nov. 28, 1995

[54] GAME APPARATUS

[76] Inventor: Richard A. Clayton, 10200 Hillview Ave., Chatsworth, Calif. 91311

[21] Appl. No.: 88,981

[22] Filed: Jul. 7, 1993

[51] Int. Cl.[6] ..... A63F 9/00

[52] U.S. Cl. ..... 273/445; 239/70; 239/241; 239/373

[58] Field of Search ..... 273/459, 445, 273/446, 440, 349, 395, 396, 397; 239/97, 98, 70, 373, 331, 251, 252, 265.11, 241

[56] References Cited

U.S. PATENT DOCUMENTS

| | | | |
|---|---|---|---|
| 132,407 | 10/1872 | Neer | 239/373 X |
| 285,055 | 9/1883 | Morrell | 239/331 X |
| 1,074,336 | 9/1913 | Wismar | 239/241 |
| 1,999,470 | 4/1935 | Munz | 239/241 X |
| 2,979,271 | 4/1961 | Boyden | 239/241 X |
| 3,594,000 | 7/1971 | Glass et al. | 273/445 X |
| 3,843,127 | 10/1974 | Lack | 273/349 |
| 4,526,366 | 7/1985 | Kendon | 273/349 X |
| 4,579,340 | 4/1986 | Jenkins et al. | 273/395 X |
| 5,195,751 | 3/1993 | Senart | 273/349 |

*Primary Examiner*—Paul E. Shapiro

[57] ABSTRACT

A game apparatus combines a rotatably mounted nozzle with propulsion and indexing mechanisms to provide a game in which players assume positions radially spaced about the nozzle's axis of rotation and actuate the propulsion mechanism as necessary to divert the nozzle's output orifice from pointing toward their individual positions. The apparatus further employs a timer to control the discharge of water or other material from the nozzle toward a player position selected by the indexing mechanism.

28 Claims, 5 Drawing Sheets

GAME APPARATUS

BACKGROUND OF THE INVENTION

1. Field of the Invention

The present invention relates in certain aspects to games and toys which project water or other material, and to rotary game devices. More particularly, the present invention relates to a novel game apparatus which combines a projecting device with elements of chance and surprise.

2. Brief Description of the Prior Art

Children have long been amused by lawn sprinklers and similar toys which project water into the air in generally predictable patterns. Likewise, adults have long been amused by gaming device s such as slot machines, roulette wheels and the like which provide a period of mechanical activity during which players await with anticipation the outcome of the mechanical activity. The prior art is lacking, however, in games or toys which combine the play value of the aforementioned water sprinkling devices with the excitement provided by a game of chance.

SUMMARY OF THE INVENTION

The present invention comprises, in its simplest form, a mechanism capable of projecting matter toward a plurality of player positions, plus mechanisms for selecting when to project the matter and for selecting which of the player positions to project the matter towards.

In practice, high play value is likely for an embodiment of the invention in which the matter to be projected is water, and the aforementioned mechanisms comprise a rotatory nozzle which spins about an axis central to the player positions, an indexing device which stops the nozzle at generally unpredictable intervals to point at an indexed player position, a trigger to allow the indexed player to restart rotation of the nozzle, and a clocking device which initiates the discharge of water from the nozzle toward an indexed player, after the expiration of a period of play involving rotation of the nozzle among the players.

Therefore it is among the primary objectives of the present invention to provide a novel game apparatus which spins a nozzle about a rotary mount to selectively point the nozzle at players, allows a currently selected player to trigger a propulsion means to spin the nozzle away from himself, and which, through means beyond the immediate control of the players, opens a valve or otherwise actuates a flow controlling or forcing mechanism to surprise a selected player with a spray of liquid from the nozzle.

It is noted that forms of matter other than water may be of play value when projected by embodiments of the present invention. For example, the invention may be used to project foam or other material from an aerosol can, or a catapult type projecting device might be incorporated to allow the invention to discharge a foam rubber hall or other solid object.

BRIEF DESCRIPTION OF THE DRAWINGS

The present invention, beth as to its organization and manner of operation, together with further objects and advantages thereof, may best be understood with reference to the following description, taken in connection with the accompanying drawings in which.

DESCRIPTION OF EXEMPLARY EMBODIMENTS

Figure 1:
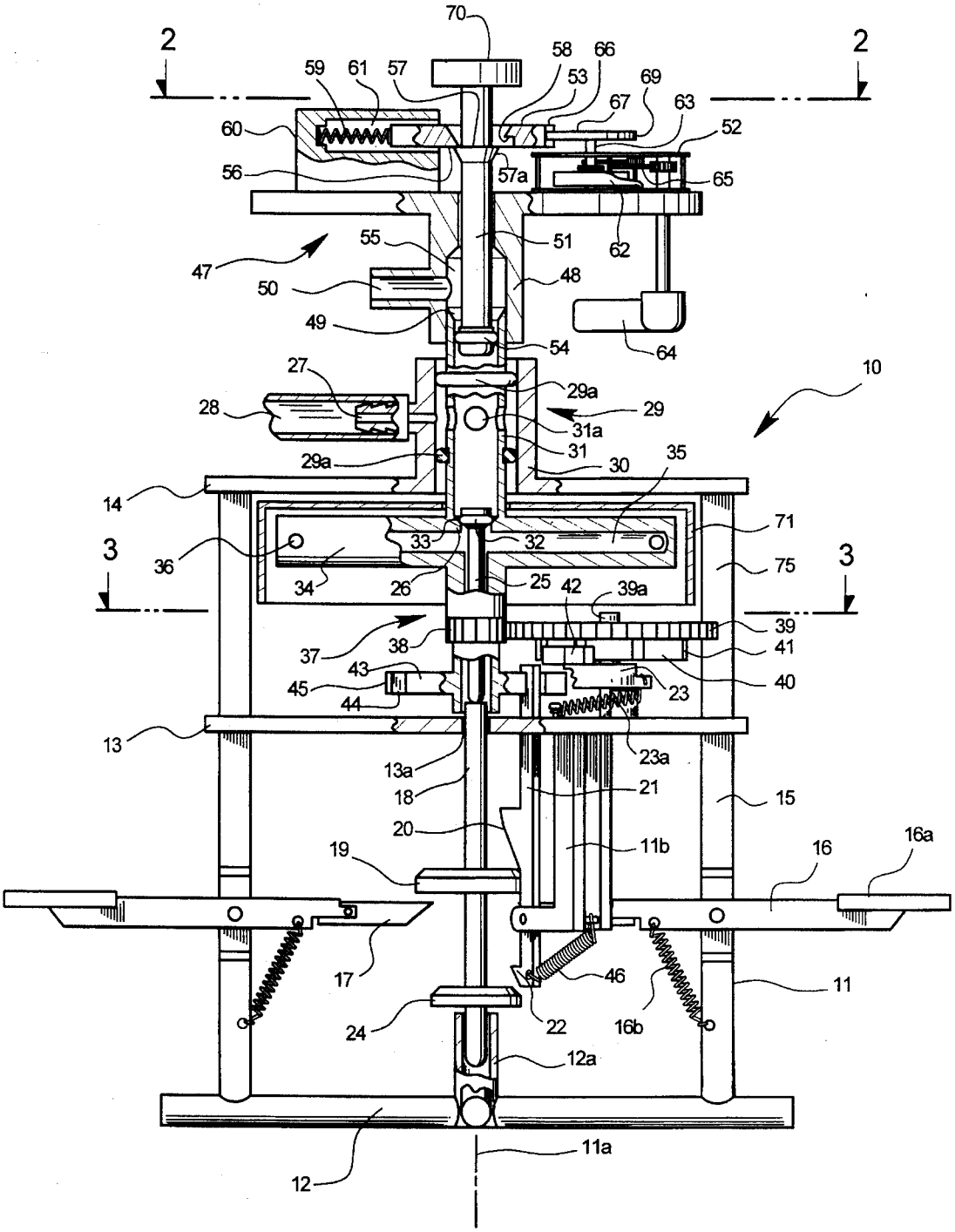
FIG. 1 is a side elevational view, partly in section, of a novel game apparatus incorporating the present invention.

Referring to FIG. 1, there is shown by way of illustration, but not of limitation, a water cannon game apparatus designed and constructed in accordance with this invention. The game apparatus, generally indicated in the direction of arrow 10, includes a frame 11 generally symmetrical about a vertical axis 11*a*, having a base 12, an intermediate platform 13, an upper platform 14, and four vertical members 15 equally spaced about the vertical axis 11*a*. A propulsion triggering lever 16 is pivotally supported on each of the four vertical members 15 such that the longitudinal axis of each lever 16 is radially aligned with the vertical axis of the frame 11. Each lever 16 has a pawl 17 pivotally carried on its inward end and a handle or paddle 16*a* carried outwardly for manual actuation by players of the game.

A shaft 18, having propulsion actuation and index release functions which will be described herein, is carried on the frame 11 so as to be longitudinally coaxial with the vertical axis 11*a* and to be upwardly and downwardly movable between an upper position and a lower position along the axis 11*a*. A tube 12*a* on base 12 and a hole 13*a* in intermediate platform 13 serve as guides for shaft 18. A disk 19 is positioned on shaft 18 such that the pawl 17 of any lever 16 may engage the disk 19 during a portion of the pivotal arc of the lever 16. Pivotal motion of the lever 16 in the direction which raises pawl 17 upward away from base 12 causes pawl 17 to engage disk 19 and raise disk 19 and shaft 18 upward along the vertical axis 11*a* of the frame 11. As disk 19 is raised it engages a shoulder 20 protruding from a bar 21 which is pivotally carried on the frame 11 by supports 11*b*. The upper end of bar 21 normally engages one of four index slots 44 in a disk 43 to prevent a rotor assembly 37 from rotating with respect to the frame 11. Further upward movement of disk 19 against shoulder 20 causes bar 21 to pivot about its mount such that the upper end of bar 21 moves radially outward from the slot 44 of disk 43 and a hook 22 on the lower end of bar 21 moves radially inward toward the shaft 18. As it moves outward, the upper end of bar 21 engages a latch 23 carried on frame 11 which is oriented to prevent movement of the upper end of bar 21 back toward disk 42. Further pivotal movement of the lever 16 causes pawl 17 to disengage from disk 19, allowing shaft 18 to move downward with respect to the frame 11 until another disk 24 on shaft 18 engages hook 22 to prevent shaft 18 from returning to its lower position. Upon release of the lever 16, a spring 16*b* urges lever 16 toward its original position. Pawl 17 pivots as it contacts the upper side of disk 19 to slide past the disk and allow lever 16 to complete its return to the original position.

Actuation of the rotor propulsion system is as follows: The upper end of shaft 18 engages the plunger 25 of a valve 26 which is supplied with water through a passageway 27 from an inlet 28 and through a swivel coupling 29 having an outer housing 30, which is mounted on the upper platform 14 of frame 11, and an inner tube 31. Holes 31*a* allow water to enter tube 31. Two O-rings 29*a* form a seal between housing 30 and tube 31. The plunger 25 has a rubber O-ring 32 which normally seals the inner tube 31 at a valve seat 33. When the shaft 18 is raised upward by lever 16 it raises plunger 25 to open the valve 26 thereby allowing water to flow through a pair of arms 34, each having a passageway 35 exiting the system through an orifice 36. The orifices 36 are oriented such that water discharged through them provides rotational force to the rotor assembly 37 which comprises among other things the valve 26, arms 34, the inner tube 31 of swivel coupling 29, and disk 43. Rotational mounting of the rotor assembly 37 to the frame 11 is provided by swivel coupling 29 on the upper platform 14 and by shaft 18 at the intermediate platform 13.

Figure 3:
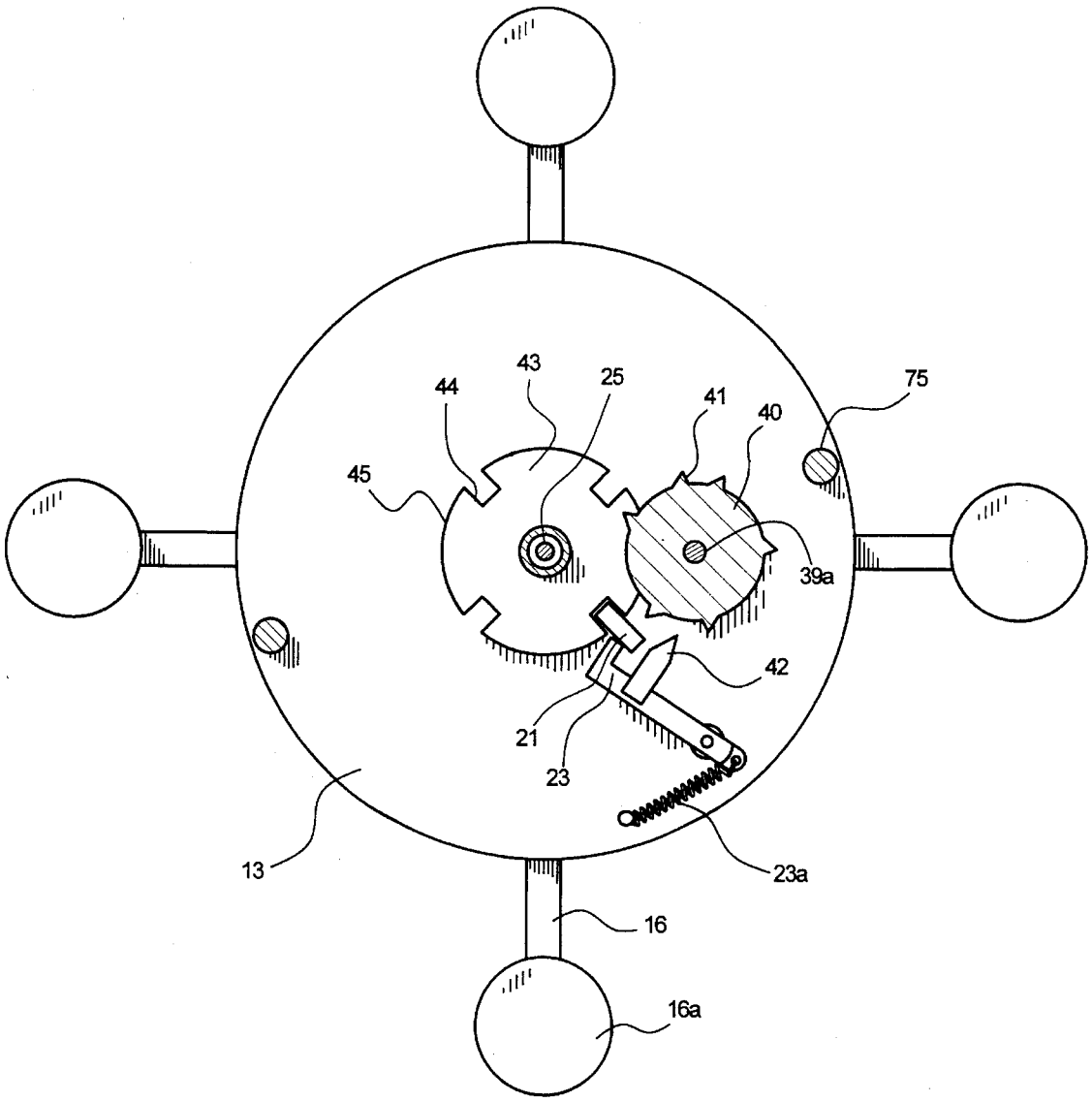
FIG. 3 is a cross-sectional view taken in the direction of arrows 3—3 of FIG. 1.

The indexing mechanism comprising bar 21 and disk 43 is designed to stop rotation of the rotor assembly 37 at ninety degree intervals, corresponding to four player positions about the game apparatus, by virtue of the ninety degree spacing of index slots 44. An index sequencing mechanism comprising a cam assembly 40 and latch 23 causes the number of ninety degree intervals between index stops to vary, in a manner generally unpredictable to players of the game, from one actuation of rotor propulsion to another. As the rotor assembly 37 turns, a gear 38 on the rotor assembly drives another gear 39 which is rotatably carried on the intermediate platform 13 of frame 11. Gear 39 is coaxially attached to cam assembly 40 whose cams 41 are selectively brought into contact with a shoulder 42 of latch 23 by rotation of gear 39 and cam assembly 40. Engagement of a cam 41 with the shoulder 42 disengages latch 23 from bar 21. A spring 46 urges bar 21 into contact with the outer rim 45 of disk 43. The rotor assembly 37 continues to rotate until a slot 44 becomes aligned with bar 21 whereby spring 46 urges bar 21 into engagement with the slot to halt rotation. The ratio of gear 38 to gear 39 and spacing between the cams 41 determine how many slots 44 will pass the position of alignment with bar 21 before bar 21 is released from latch 23. Thus, if the spacing between cams 41 is made irregular, as in FIG. 3, the number of quarter turns of the rotor 37, for a given actuation of rotor propulsion, will be irregular and both rotor travel duration and stopping position will be generally unpredictable. When bar 21 enters a slot 44, the hook 22 on bar 21 is pivoted away from engagement with disk 24 such that shaft 18 may return to its original lower position. Water pressure in tube 31 forces plunger 25 downward to engage O-ring 32 with valve seat 33 thereby closing valve 26 to shut off the rotational force of water from arms 34.

The rotor assembly 37 additionally comprises on its upper end a spray assembly 47 having a valve 48, a valve seat 49, a nozzle 50, a plunger 51, a timer 52 and a latch 53. Water is supplied to spray assembly 47 through the inner tube 31 of swivel coupling 29. An O-ring 54 on plunger 51 normally forms a seal with valve seat 49 to keep water from entering the passage 55 within valve 48. A shoulder 56 of latch 53 normally engages a disk 57 on plunger 51 to prevent water pressure within tube 31 from forcing plunger 51 upward to open valve 48.

Timer 52 is of a spring wound mechanical type, having a torsion spring 62 which biases a shaft 63 to rotate to a rest position. The timer 52 is set or activated by using handle 64 to rotate the timer mechanism including shaft 63 against the bias of spring 62 and then releasing the handle 64. A clock mechanism 65 meters the speed with which spring 62 drives shaft 63 back to its rest position. The further shaft 63 is rotated against the bias of spring 62, the longer timer 52 will run before shaft 63 again reaches rest position.

A finger 66 protruding from latch 53 is biased by spring 59 into engagement with a wheel 67 affixed to shaft 63. With timer 52 in its off state, which corresponds to the rest position of shaft 63 and the normal position of latch 53, finger 66 rests in a slot 68 in wheel 67. As shaft 63 and wheel 67 are rotated away from the rest position by actuation of timer 52, finger 66 is forced out of slot 68 and into engagement with the outer rim 69 of wheel 67. Latch 53 is thereby forced back within slots 61 of guides 60, against the bias of spring 59, such that shoulder 56 is disengaged from disk 57 of plunger 51. Plunger 51 is forced by water pressure upward within valve 48 until disk 57 encounters another shoulder 58 of latch 53 which restricts the plunger from further upward movement. With disk 57 and shoulder 58 thus engaged O-ring 54 remains within valve seat 49 and valve 48 remains closed.

When the timer returns shaft 63 to rest position, or times out to its off state, slot 68 is realigned with finger 66 whereby spring 59 forces latch 53 back to its normal position to disengage shoulder 58 from disk 57 such that plunger 51 is free to move upward within valve 48. If the rotor 37 is in one of its indexed positions wherein bar 21 is engaged in one of the slots 44 of disk 43, then the propulsion valve 26 will be closed allowing water pressure within tube 31 to force plunger 51 upward until O-ring 54 no longer resides within valve seat 49, thus opening valve 48 to allow water to flow through passage 55 and to exit spray assembly 47 through nozzle 50.

If the rotor assembly 37 is in motion between index positions, the propulsion valve 26 will be latched open by engagement of disk 24 and hook 22 and water pressure within tube 31 will be insufficient to open valve 48. To insure this effect, the cross sectional area of passageway 27 is designed to be smaller than the minimum cross sectional areas found in the passageways of tube 31, valve 26, arms 34 or orifices 36, such that pressure within tube 31 can not build to a level sufficient to open valve 48 while valve 26 is open. This lack of pressure also allows the seals between O-rings 29*a* and tube 31 to relax so that tube 31 may rotate freely within housing 30.

Once valve 48 is opened players may close it by pushing downward on a knob 70 on the upper end of plunger 51 to return the plunger 51 to its original lower position to re-engage O-ring 54 with valve seat 49. A beveled edge 57*a* on disk 57 allows it to slide through latch 53 as plunger 51 is reset to its lower position.

Figure 2:
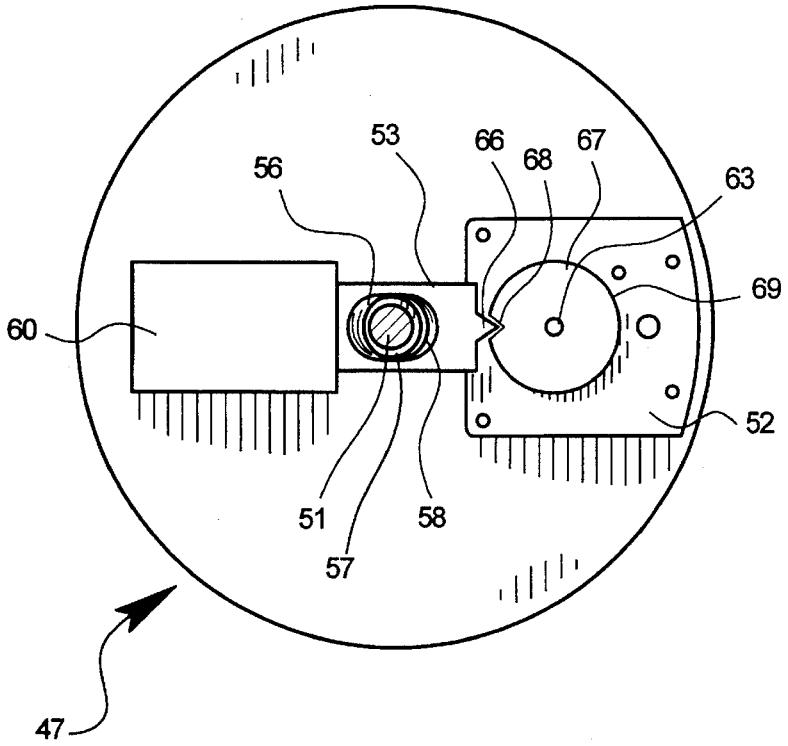
FIG. 2 is a cross-sectional view taken in the direction of arrows 2—2 of FIG. 1.

With reference to FIG. 1, FIG. 2, and the above descriptions of the timer 52 and latch 53, it is understood that the latch 53 has a three state cycle of operation, which cooperates with a device such as timer 52 having only two operating states. In this example, the timer is either in an off state or an active (set) state, and the operational states of latch 53 may be summarized as follows: A first latch state is defined when the timer 52 is in its Off state and plunger 51 is restrained from upward movement by engagement of disk 57 with shoulder 56, latch 53 being forced to the right by spring 59. A second latch state is defined when the timer 52 is set and plunger 51 is restrained by engagement of disk 57 with shoulder 58, latch 53 having been forced to the left by timer wheel 67 whereby shoulder 56 is removed from the path of disk 57 and shoulder 58 is inserted in the path of disk 57. A third latch state is defined when timer 52 is in its off state and plunger 51 is free to move upward, latch 53 having been forced again to the right by spring 59 (upon expiration of timer activity) whereby shoulder 58 is taken out of the path of disk 57.

Figure 4:
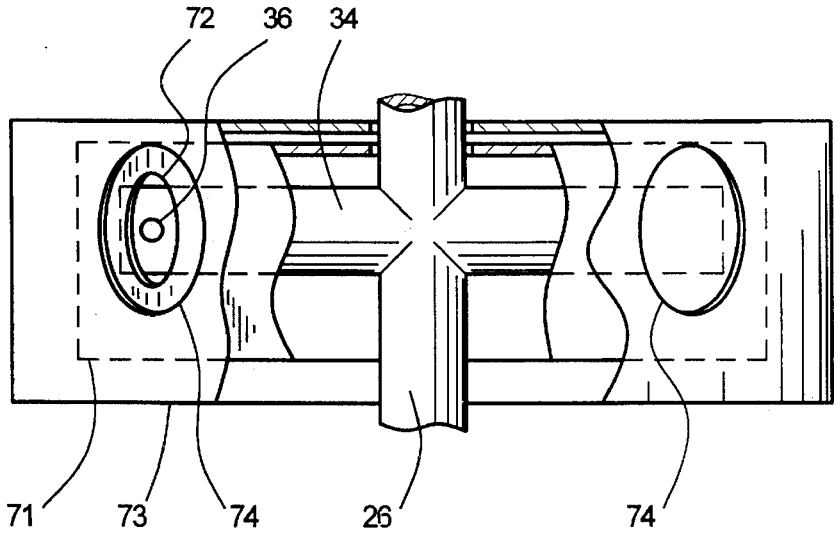
FIG. 4 is a side elevational view, partly in section, of two coaxial spray shields and a spray arm assembly employed in an embodiment of the present invention.

A shield 71 encloses arms 34 to normally prevent the water discharged from orifices 36 from striking players. The shield may optionally be rotatably carried about the vertical axis 11*a* such that water discharged through orifices 36 rotates it in a direction counter to that of rotor assembly 37. A hole 72 in the shield 71 in the optional case (shown in FIG. 4) is positioned to periodically become aligned with an orifice 36 as the shield and rotor both rotate whereby a stream of water is occasionally discharged outward among the players to add an extra element of surprise. A stationary shield 73 may be carried on frame 11 as an additional option. Shield 73 has four holes 74 positioned in alignment with the player positions so that the occasional surprise discharge occurs only if the hole 72 in the rotating shield 71 becomes aligned with an orifice 36 as the orifice 36 becomes aligned with a hole 74 in the stationary shield 73, and such that the discharge is directed toward a player position whenever it occurs.

Figure 5:
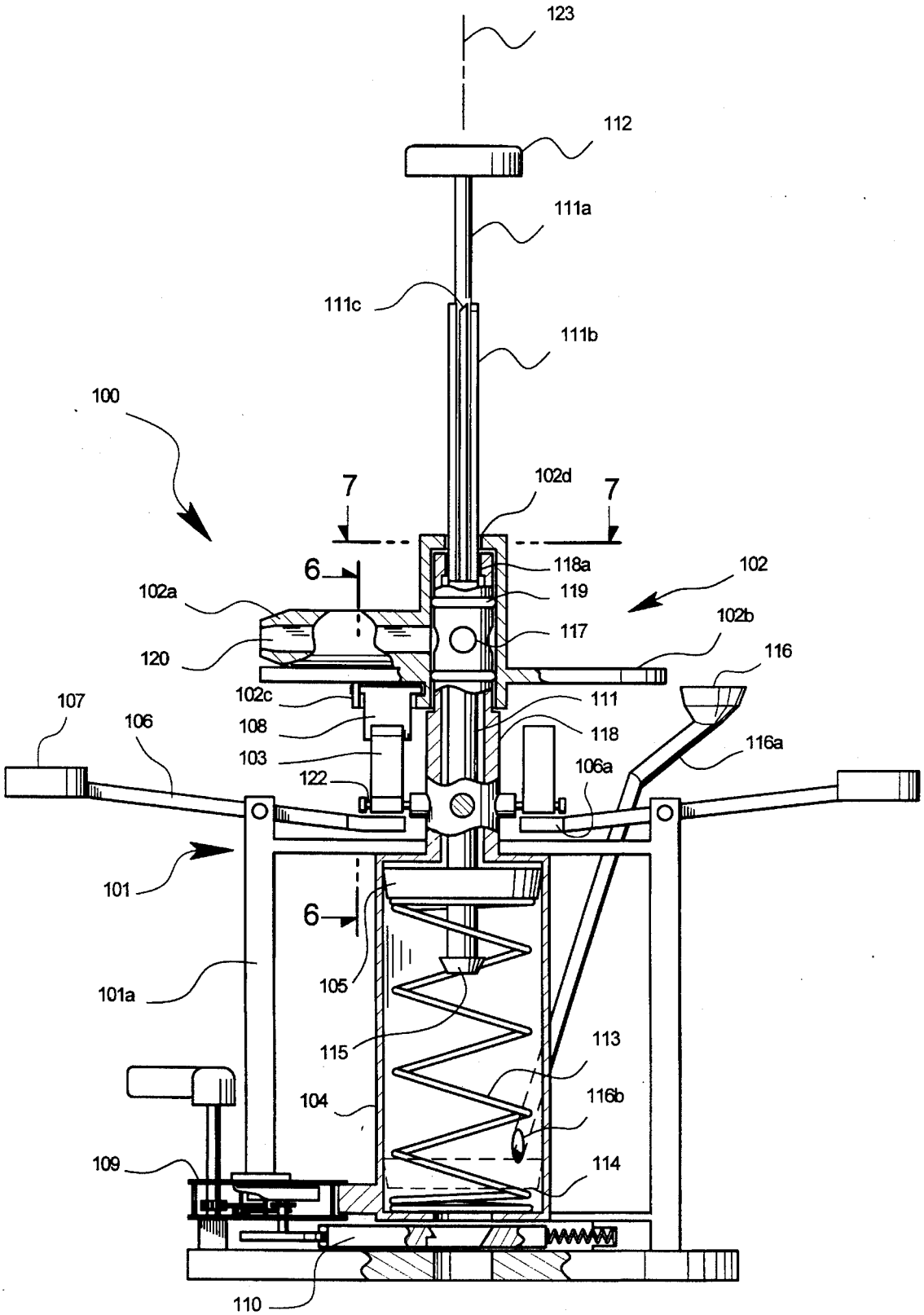
FIG. 5 is a side elevational view, partly in section, of another novel game apparatus incorporating the present invention.
Figure 6:
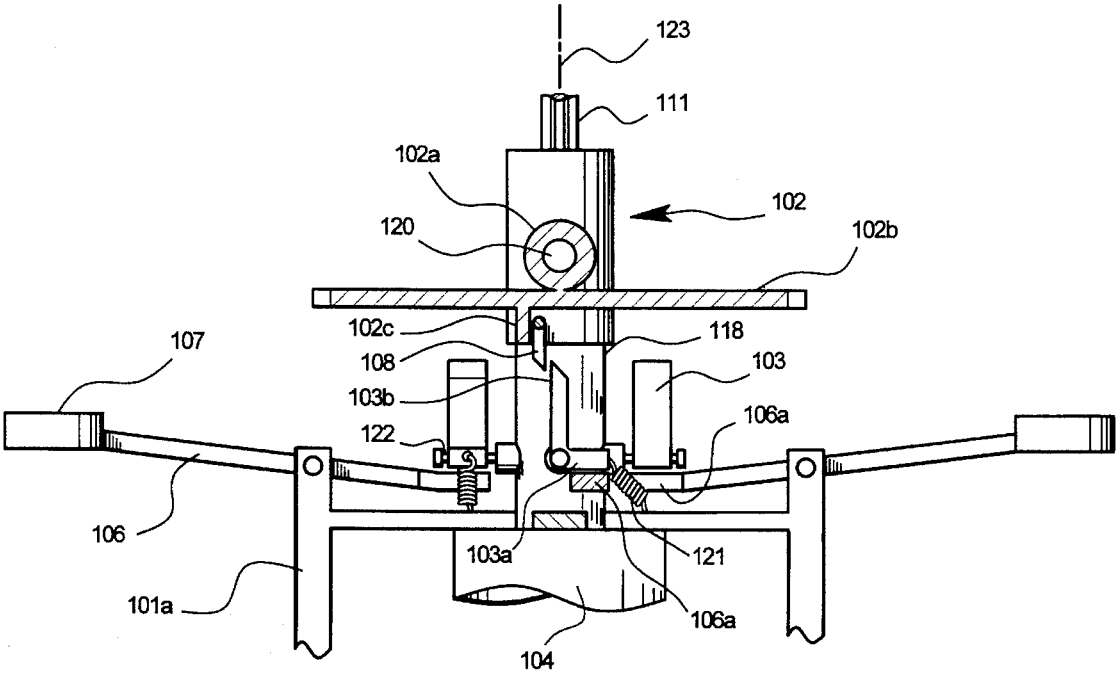
FIG. 6 is a cross-sectional view, taken in the direction of arrows 6—6 of FIG. 5.
Figure 7:
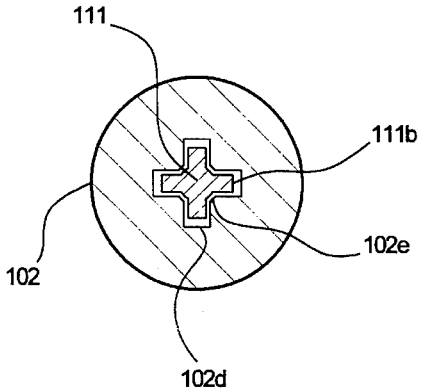
FIG. 7 is a cross-section of the apparatus of FIG. 5, taken in the direction of arrows 7—7.

It may be desirable that the game apparatus be independent and free of connections to a separate pressurized water supply (such as a garden hose) during operation. Such an embodiment is depicted in FIG. 5 and FIG. 6. The free-standing apparatus, generally indicated in the direction of arrow 100, comprises a frame 101 having four upright members 101*a* equally spaced about the axis of rotation 123 of a rotor assembly 102, four lever assemblies 103 pivotally carried on an upper appendage 118 of a cylinder 104 by shafts 122 in substantial alignment with upright members 101*a*, a plunger 105 within the cylinder 104, and levers 106 pivotally carried on the upright members 101*a*. Levers 106 include a striking end 106*a* for engagement with a horizontal member 103*a* of lever assemblies 103 whereby actuation of a lever 106, that is, downward displacement of the outside handle or paddle portion 107 of the lever 106, is translated to upward motion of striking end 106*a* which causes lever assembly 103 to pivot about shaft 122. A vertical member 103*b* of lever assembly 103 engages a pawl 108 hinged on a bracket 102*c* of the rotor assembly 102 such that pivotal movement of lever assembly 103 resulting from the described actuation of lever 106 is translated into rotary motion of rotor 102. Thus, in this embodiment the force delivered manually to the rotation triggering lever 106 is transferred mechanically to direct propelling force for the rotor 102, whereas in the previously described embodiment a similar lever (16 in FIG. 1) functions as a trigger for a separate jet powered propulsion mechanism (34 in FIG. 1 ).

An indexing mechanism (not shown in FIG. 5 for simplicity, but similar in function to the indexing mechanism of the previously described embodiment) is preferably employed to cause the rotor assembly 102 to stop rotation after an integer number of quarter revolutions such that the pawl 108 is engaged with another lever assembly 103 and so as to point a nozzle 102*a* of the rotor assembly 102 at a selected one of the player positions which correspond to the positions of the levers 106. It may be noted that since a single pawl 108 rotates as a part of rotor assembly 102, the pawl 108 may only be aligned with the triggering levers 106, 103 of one player position at a time, such that only the player position currently indexed or selected for such alignment is capable of actuating rotor propulsion.

A timer 109 having a latch 110 is mounted to the frame 101 to engage a shaft 111 of plunger 105. Manual force may be applied to a handle 112 on the end of shaft 111 to force the plunger 105 downward within cylinder 104, thereby compressing a spring 113 between plunger 105 and cylinder 104. If shaft 111 and plunger 105 are forced to a lower, or cocked, position indicated by dashed lines and the numeral 114, a shoulder 115 on shaft 111 will engage latch 110 whereby the shaft 111 and plunger 105 are restricted from upward movement. With the plunger 105 thus cocked, the cylinder is then loaded by manually pouring water through an inlet 116 having a conduit tube 116*a* and an opening 116*b* into cylinder 104. The latch 110 has a three state cycle similar to the timer latch of the previously described embodiment, whereby the timer 109 may be set or activated after the apparatus has been cocked and loaded.

Play of the game is initiated upon the setting of the timer 109. Players strike handles 107 to spin the rotor 102 to divert the nozzle 102*a* from pointing toward their positions. When the timer 109 times out, latch 110 is released allowing spring 113 to force shaft 111 and plunger 105 upward thereby forcing water upward within cylinder 104 and out through openings 117. Clearance between shaft 111 and the opening 118*a* in the upper end of upper cylinder appendage 118 is designed to be minimal to prevent excessive leakage of water. The rotor assembly 102 is rotatably carried on the upper appendage 118 of cylinder 104, having O-rings 119 to provide a seal between rotor 102 and appendage 118 above and below openings 117 such that water forced through openings 117 must exit the system through a passage 120 and nozzle 102*a* of the rotor assembly.

A secondary indexing mechanism provides positive alignment of the nozzle 102*a* with a player position at the time of discharge. This mechanism comprises indexing slots 102*d* in the opening 102*e* in the upper end of rotor 102 through which shaft 111 protrudes. When plunger 105 and shaft 111 are in the cocked position indicated in dashed lines by the numeral 114, the upper portion 111*a* of shaft 111 is positioned within opening 102*e*. Upper portion 111*a* of the shaft has a round cross-section which cannot engage the slots 102*d* so that the rotor 102 is free to rotate. When shaft 111 is released from latch 110, blades 111*b* on the lower potion of shaft 111 engage the upper end of rotor 102 to prevent further upward movement of shaft 111 and plunger 105 until rotation of the rotor 102 causes the slots 102*d* to become aligned with blades 111*b*. The blades 111*b* are provided with sloping upper surfaces 111*c* which engage similarly sloped surfaces (not shown) about opening 102*d* to assist the rotation of rotor 102 into the aforementioned alignment.

Accordingly, it can be seen that the present invention may be embodied as a novel water cannon apparatus for a game in which players take positions in a radially spaced relationship about the central vertical axis of the game apparatus, about which a rotor assembly is operably carried, said rotor assembly being engageable with an indexing mechanism whereby a nozzle carried on the rotor assembly is selectively alignable with the player positions, each position having a lever for temporarily disengaging a latch in the indexing mechanism and for actuation of a propulsion means to set the rotor into motion, said nozzle having a water supply controlled by an event metering device which causes water to discharge from the nozzle in response to a triggering set of events.

The present invention further provides novel propulsion and indexing mechanisms for a rotor assembly, a novel swivel coupling for connection of a rotor to a water supply, and novel discharge control means for gating or delivery of water to a nozzle.

While certain embodiments of the present invention have been presented and described herein, it is to be understood that other embodiments have been contemplated and considered. The mechanisms presented are not intended to be limiting as to the scope of this invention, and it will be obvious to those skilled in the art that changes and modifications may be made in the structures disclosed, and similar mechanisms may be constructed, without departing from the spirit of the invention defined in the following claims.

What is claimed is:

1. A game apparatus comprising movable discharge means for projecting fluid from said game apparatus toward a plurality of player positions about said game apparatus;

means for supplying fluid to said discharge means for projection therefrom;

propulsion means for imparting motion to said discharge means;

motion control means for selectively stopping motion of said discharge means for alignment within discrete boundaries corresponding to said player positions whereby said discharge means may be selectively aimed at said player positions;

said propulsion means adapted to automatically impart motion to said discharge means when said discharge means is not aligned within the boundaries of a selected player position.

2. The invention of claim 1 including discharge control means for selective actuation of said discharge means.

3. A game apparatus comprising movable discharge means for projecting matter from said game apparatus toward a plurality of player positions about said game apparatus;

propulsion means for imparting motion to said discharge means:

motion control means for stopping motion of said discharge means whereby said discharge means may be selectively aimed at said player positions:

said motion control means comprising indexing means for setting of discrete motion stopping boundaries corresponding to said player positions:

said discharge means comprising a rotor operably carried for rotation about an axis;

said rotor comprising a nozzle;

discharge control means for selective actuation of said discharge means;

a valve cooperating with said discharge control means whereby a supply of pressurized matter may be connected to said nozzle, for discharge therefrom, under control of said discharge control means.

4. A game apparatus comprising movable discharge means for projecting matter from said game apparatus toward a plurality of player positions about said game apparatus:

propulsion means for imparting motion to said discharge means:

motion control means for stopping motion of said discharge means whereby said discharge means may be selectively aimed at said player positions;

said motion control means comprising indexing means for setting of discrete motion stopping boundaries corresponding to said player positions;

said discharge means comprising a rotor operably carried for rotation about an axis;

said rotor comprising a nozzle;

discharge control means for selective actuation of said discharge means;

pressurization means cooperating with said discharge control means whereby a supply of matter connected to said nozzle may be pressurized for discharge therefrom under control of said discharge control means.

5. The invention of claim 4 wherein said pressurization means comprises a pump.

6. A game apparatus comprising movable discharge means for projecting matter from said game apparatus toward a plurality of player positions about said game apparatus;

propulsion means for imparting motion to said discharge means:

motion control means for stopping motion of said discharge means whereby said discharge means may be selectively aimed at said player positions:

discharge control means for selective actuation of said discharge means;

said discharge control means comprising a timing means having at least two states of operation;

said timing means when in a first state inhibiting actuation of said discharge means, and when in a second state said timing means abetting actuation of said discharge means.

7. The invention of claim 6 wherein said discharge control means comprises a valve;

said timing means being adapted to keep said valve closed while said timing means is in said first state, and to allow said valve to open when said timing means is in said second state.

8. The invention of claim 6 including a pump adapted to pressurize matter for projection from said discharge means;

said timing means being adapted to actuate said pump wherein said second state.

9. A game apparatus comprising movable discharge means for projecting matter from said game apparatus toward a plurality of player positions about said game apparatus;

propulsion means for imparting motion to said discharge means;

motion control means for stopping motion of said discharge means whereby said discharge means may be selectively aimed at said player positions;

said motion control means comprising indexing means for setting of discrete motion stopping boundaries corresponding to said player positions;

said discharge means comprising a rotor operably carried for rotation about an axis;

said propulsion means comprising jet means cooperating with said rotor whereby discharge of said jet means urges said rotor to rotate.

10. A game apparatus comprising movable discharge means for projecting matter from said game apparatus toward a plurality of player positions about said game apparatus;

propulsion means for imparting motion to said discharge means;

motion control means for stopping motion of said discharge means whereby said discharge means may be selectively aimed at said player positions;

said propulsion means comprising at least one lever cooperating with said rotor whereby pivotal motion of said lever induces rotational motion of said rotor.

11. A game apparatus comprising movable discharge means for projecting matter from said game apparatus toward a plurality of player positions about said game apparatus;

propulsion means for imparting motion to said discharge means;

motion control means for stopping motion of said discharge means whereby said discharge means may be selectively aimed at said player positions:

trigger means for manual actuation of said propulsion means.

12. The invention of claim 11 including said motion control means comprising indexing means for setting of discrete motion stopping boundaries corresponding to said player positions;

said discharge means comprising a rotor operably carried for rotation about an axis.

13. The invention of claim 12 wherein said trigger means comprises a plurality of manually actuated paddles radially spaced about the axis of rotation of said rotor;

said paddles adapted to selectively actuate said propulsion means.

14. The invention of claim 13 wherein said spacing of said paddles generally corresponds to Said stopping boundaries of said indexing means.

15. The invention of claim 12 wherein said player positions are uniformily spaced about said rotor axis and said motion control means includes sequencing means for causing the angular distances traveled by said rotor upon sequential triggerings of said propulsion means to substantially be irregular integer multiples of the angular spacing between adjacent said player positions.

16. The invention of claim 15 wherein said sequencing means comprises a cam wheel;

said cam wheel comprising a plurality of cams which cooperate with other elements of said indexing means to cause the prevention of motion of said rotor;

said cams being radially spaced about said cam wheel at irregular intervals.

17. The invention of claim 11 wherein actuation of said trigger causes power from a pressurized supply of fluid to be applied to said movable discharge means to impart motion thereto.

18. The invention of claim 11 wherein said trigger serves to mechanically transmit force from an actuating player to said movable discharge means for imparting motion thereto.

19. A game apparatus comprising a rotor, jet propulsion means for urging rotary motion of said rotor, and indexing means for selective stopping of said rotor within discrete boundaries.

20. A game apparatus comprising a plurality of player positions;

means for directional discharge of matter toward a selected player position;

means to actuate the discharge of said matter;

targeting means for selecting a target player position, whereby said discharge means is prepared for delivery of said matter toward said target player position;

automatic target sequence scrambling means cooperating with said targeting means to cause sequentially targeted player positions to be selected in a substantially irregular manner, such that the player position to be next targeted cannot be predicted based solely on knowledge of which player position was last targeted, said irregular manner being beyond the control of the players.

21. The invention of claim 20 wherein said means for directional discharge of matter comprises discharge directing means movable for selective alignment with said player positions.

22. A game apparatus comprising means defining a plurality of discrete player positions spaced about said apparatus;

discharge means for projecting matter from said game apparatus toward said player positions;

said discharge means comprising a rotor;

propulsion means for imparting rotary motion to said rotor;

indexing means cooperating with said rotor to stop said rotor for selective alignment with said player positions;

each of said player positions comprising trigger means for selective actuation of said propulsion means.

23. The invention of claim 22 wherein said rotor comprises a nozzle adapted for selective alignment with said player positions in cooperation with said indexing means;

said discharge means comprising means for supplying pressurized liquid to said nozzle for expulsion therefrom.

24. A game apparatus comprising a rotor operably carried for rotation about an axis;

propulsion means for imparting rotary motion to said rotor;

trigger means for manual actuation of said propulsion means;

indexing means for defining a plurality of player positions about said game apparatus and for selectively stopping rotation of said rotor for alignment of said rotor with selected said player positions;

trigger selectivity means whereby said propulsion means may be triggered from said player positions currently selected for rotor alignment by said indexing means, and said propulsion means may not be triggered from said player positions which are not currently selected for rotor alignment.

25. A game apparatus comprising movable discharge means for projecting matter from said game apparatus toward selected player positions about said game apparatus;

jet propulsion means for imparting motion to said discharge means;

motion control means for stopping motion of said discharge means whereby said discharge means may be selectively aimed at said player positions;

discharge control means for selective actuation of said discharge means to project matter toward selected player positions.

26. A game apparatus comprising discharge means movable for projecting fluid from said game apparatus in a range of directions;

means for supplying fluid to said discharge means;

said discharge means comprising a rotor operably carried for rotation about an axis;

propulsion means for driving said rotor through a range of rotary motion;

said propulsion means being at least partially automatic so as to be independent of and not require manual manipulation of said rotor through said range of rotary motion;

motion control means for selectively stopping motion of said rotor to aim said discharge means at a player of the game;

discharge control means for selective actuation of said discharge means.

27. The invention of claim 26 wherein said discharge control means comprises a valve whereby a supply of matter may be connected to said nozzle, for discharge therefrom, under control of said discharge control means.

28. The invention of claim 26 including a pump cooperating with said discharge control means whereby a supply of matter connected to said nozzle may be pressurized for discharge therefrom under control of said discharge control means.

* * * * *